US007610072B2

(12) United States Patent
Ye

(10) Patent No.: US 7,610,072 B2
(45) Date of Patent: Oct. 27, 2009

(54) SUPERCONDUCTIVE STRIPLINE FILTER UTILIZING ONE OR MORE INTER-RESONATOR COUPLING MEMBERS

(75) Inventor: Shen Ye, Cupertino, CA (US)

(73) Assignee: Superconductor Technologies, Inc., Santa Barbara, CA (US)

( * ) Notice: Subject to any disclaimer, the term of this patent is extended or adjusted under 35 U.S.C. 154(b) by 361 days.

(21) Appl. No.: 10/944,339

(22) Filed: Sep. 17, 2004

(65) Prior Publication Data

US 2005/0107060 A1 May 19, 2005

Related U.S. Application Data

(60) Provisional application No. 60/504,578, filed on Sep. 18, 2003.

(51) Int. Cl.
*H01P 1/203* (2006.01)
*H01B 12/02* (2006.01)

(52) U.S. Cl. ..... 505/210; 333/99 S; 333/204

(58) Field of Classification Search ..... 333/204, 333/205, 99 S, 203; 505/210
See application file for complete search history.

(56) References Cited

U.S. PATENT DOCUMENTS

| | | | | |
|---|---|---|---|---|
| 3,656,162 | A | 4/1972 | Mee | |
| 4,157,517 | A * | 6/1979 | Kneisel et al. | 333/205 |
| 4,418,324 | A | 11/1983 | Higgins | |
| 4,423,396 | A | 12/1983 | Makimoto et al. | |
| 4,513,263 | A | 4/1985 | Minnis | |
| 4,881,050 | A | 11/1989 | Swanson, Jr. | |
| 4,992,759 | A | 2/1991 | Giraudeau et al. | |
| 4,996,188 | A | 2/1991 | Kommrusch | |

(Continued)

FOREIGN PATENT DOCUMENTS

| | | |
|---|---|---|
| DE | 2 317 375 | 10/1974 |

(Continued)

OTHER PUBLICATIONS

Aitchison, C. et al., "Lumped-Circuit Elements at Microwave Frequencies," *IEEE Transactions on Microwave Theory and Techniques*, vol. MTT-19, No. 12, pp. 928-937 (Dec. 1971).

(Continued)

*Primary Examiner*—Benny T. Lee
(74) *Attorney, Agent, or Firm*—Merchant & Gould P.C.

(57) ABSTRACT

An inter-resonator coupling scheme for a filter is disclosed. An inter-resonator coupling member is located between successive resonators in the filter. By adjusting the length and/or the proximity of the inter-resonator coupling member relative to the adjacent resonators, the ratio of energy transferred from resonator to resonator (via the inter-resonator coupling member) may be increased and/or decreased. By increasing the ratio of energy transferred from resonator to resonator, the bandwidth of the filter is increased and is made relatively insensitive to tuning which may occur via manipulation of field disturbances introduced by tuning tips. The inter-resonator coupling member is made of a conductive or superconductive material and contains at least three sections. The first section runs substantially parallel to an edge of the first resonator that is not profoundly influenced by the source of field disturbance. The third section runs substantially parallel to an edge of the second resonator that is not profoundly influenced by the source of field disturbance. A second section connects the first and third sections.

16 Claims, 8 Drawing Sheets

U.S. PATENT DOCUMENTS

| | | | | |
|---|---|---|---|---|
| 5,132,282 | A | 7/1992 | Newman et al. | |
| 5,187,459 | A * | 2/1993 | Russell et al. | 333/204 |
| 5,231,078 | A | 7/1993 | Riebman et al. | |
| 5,351,020 | A | 9/1994 | Okamura et al. | |
| 5,391,543 | A | 2/1995 | Higaki et al. | |
| 5,416,454 | A | 5/1995 | McVeety | |
| 5,523,699 | A | 6/1996 | Miyagawa | |
| 5,525,942 | A | 6/1996 | Horii et al. | |
| 5,616,538 | A | 4/1997 | Hey-Shipton et al. | |
| 5,616,539 | A | 4/1997 | Hey-Shipton et al. | |
| 5,618,777 | A | 4/1997 | Hey-Shipton et al. | |
| 5,677,653 | A | 10/1997 | Särkkä | |
| 5,739,731 | A | 4/1998 | Hicks et al. | |
| 5,786,303 | A * | 7/1998 | Mansour | 505/210 |
| 5,888,942 | A | 3/1999 | Matthaei | |
| 5,949,302 | A | 9/1999 | Särkkä | |
| 5,968,876 | A | 10/1999 | Sochor | |
| 6,049,726 | A | 4/2000 | Gruenwald et al. | |
| 6,085,605 | A | 7/2000 | Koivisto | |
| 6,122,533 | A | 9/2000 | Zhang et al. | |
| 6,147,577 | A | 11/2000 | Cavey | |
| 6,347,237 | B1 | 2/2002 | Eden et al. | |
| 6,438,394 | B1 | 8/2002 | Zhang et al. | |
| 6,522,217 | B1 | 2/2003 | Shen | |
| 6,529,750 | B1 | 3/2003 | Zhang et al. | |
| 6,559,741 | B2 * | 5/2003 | Takeda | 333/204 |
| 6,791,430 | B2 | 9/2004 | Borzenets et al. | |

FOREIGN PATENT DOCUMENTS

| | | | |
|---|---|---|---|
| DE | 40 09 076 | A1 | 9/1991 |
| DE | 41 22 697 | A1 | 1/1992 |
| EP | 0 350 256 | A2 | 1/1990 |
| EP | 0 720 248 | A2 | 7/1996 |
| EP | 1 202 375 | A2 | 5/2002 |
| FR | 2 577 067 | | 8/1986 |
| JP | 57-97715 | | 6/1982 |
| JP | 1-170102 | | 7/1989 |
| JP | 4-72804 | | 3/1992 |
| JP | 2001-211004 | | 8/2001 |
| WO | WO 90/06627 | | 6/1990 |
| WO | WO 96/12320 | | 4/1996 |
| WO | WO 98/00880 | | 1/1998 |
| WO | WO 99/52171 | | 10/1999 |
| WO | WO 01/08250 | A1 | 2/2001 |

OTHER PUBLICATIONS

Chaloupka, H., "High-Temperature Superconductors—A Material for Miniaturized or High-Performance Microwave Components," *Frequenz*, vol. 44, No. 5, pp. 141-144 (May 1990).

Fathy, A. et al., "Critical Design Issues in Implementing a YBCO Superconductor X-Band Narrow Bandpass Filter Operating at 77K," *IEEE MTT-S Digest*, pp. 1329-1332 (1991).

Fathy, A. et al., "Superconducting Narrow Band Pass Filters for Advanced Multiplexers," *IEEE MTT-S Digest*, pp. 1277-1280(1993).

Field, P. et al., "Asymmetric Bandpass Filter Using a Novel Microstrip Circuit," *IEEE Microwave and Guided Wave Letters*, vol. 2, No. 6, pp. 247-249 (Jun. 1992).

Hammond, R. et al., "Designing with superconductors," *IEEE Spectrum*, vol. 30, No. 4, pp. 34-39 (Apr. 1993).

Hong, J. et al., "Theory and Experiment of Novel Microstrip Slow-Wave Open-Loop Resonator Filters," *IEEE Transactions on Microwave Theory and Techniques*, vol. 45, No. 12, pp. 2358-2365 (Dec. 1997).

Morgan, D. et al., "Lumped Element Filters for Electronic Warfare Systems," *Microwave Journal*, pp. 127-136 (Feb. 1986).

Nagai, Y. et al., "Properties of superconductive bandpass filters with thermal switches," *Applied Physics Letters*, vol. 63, No. 6, pp. 830-832 (Aug. 9, 1993).

Newman, N. et al., "High-Temperature Superconducting Microwave Devices: Fundamental Issues in Materials, Physics, and Engineering," *Journal of Superconductivity*, vol. 6, No. 3, pp. 119-160 (1993).

Patzelt, T. et al., "High-temperature superconductive lumped-element microwave allpass sections," *Electronics Letters*, vol. 29, No. 17, pp. 1578-1580 (Aug. 19, 1993).

Reppel, M. et al., "Novel Approach for Narrowband Superconducting Filters," *IEEE MTT-S Digest*, pp. 1563-1566 (1999).

Swanson, D., "Thin-Film Lumped-Element Microwave Filters," *IEEE MTT-S Digest*, pp. 671-674 (1989).

Swanson, Jr., D. et al., "A 10 GHz Thin Film Lumped Element High Temperature Superconductor Filter." *IEEE MTT-S Digest*, pp. 1191-1193 (1992).

Zhang, D. et al, "Narrowband lumped-element microstrip filters using capacitively-loaded inductors," *IEEE MTT-S International Microwave Symposium Digest*, vol. 2, pp. 379-382 (May 16-20, 1995).

Zhang, D. et al., "Microstrip Filters for Wireless Communications Using High-Temperature Superconducting Thin Films," *Applied Superconductivity*, vol. 3, No. 7-10, pp. 483-496 (1995).

* cited by examiner

SUPERCONDUCTIVE STRIPLINE FILTER UTILIZING ONE OR MORE INTER-RESONATOR COUPLING MEMBERS

CROSS-REFERENCE TO RELATED APPLICATION

This application claims the benefit of U.S. Provisional Application Ser. No. 60/504,578, filed on Sep. 18, 2003 entitled STRIPLINE FILTER UTILIZING ONE OR MORE INTER-RESONATOR COUPLING MEANS. Such application is incorporated herein by reference.

FIELD OF THE INVENTION

The invention relates generally to a stripline filter utilizing one or more inter-resonator coupling members, and more particularly to a high temperature superconductive planar stripline or microstrip circuit that utilizes one or more inter-resonator coupling members to preserve bandwidth while allowing filter tuning.

BACKGROUND

In the field of stripline filter design, it is commonplace to employ a filter scheme as generally shown in FIG. 1. FIG. 1 depicts a filter 100 having three resonators 102, 104 and 106, an Input and an Output. Although the filter 100 is depicted as having three resonators, the filter 100 could possess any number of resonators, in principle. An input signal 108 propagates along an input transmission path (not shown) toward and coupled to the first resonator 102. If the input signal 108 contains energy in frequency ranges falling primarily outside of the range of frequencies, or passband, close to the resonant frequency of the first resonator 102, the signal 108 is substantially reflected so that it travels backwards along the input transmission path (not shown). The passband is controlled by adjusting the external and internal couplings to the resonator. If, on the other hand, the input signal 108 contains energy in frequency ranges falling primarily within the passband frequencies, an electromagnetic resonance is established within the first resonator 102. The electromagnetic resonance established within the first resonator 102- causes an electromagnetic wave to be coupled to the second resonator 104. Once again, the signal 108 is either reflected from or established within the second resonator 104, depending upon whether it contains energy in frequency ranges falling primarily within the frequency range determined by the coupling between resonator 102 and the second resonator 104. The strength of the electromagnetic wave propagating to the second resonator 104 is a function of, among other variables, the distance between the first and second resonators 102 and 104. Generally, the closer together the first and second resonators 102 and 104, the greater the strength of the electromagnetic wave in the second resonator. Thus, the general scheme of such a filter is that an electromagnetic wave propagates from resonator to resonator as long as it is within the frequency range determined by the resonant frequency of each resonator and the couplings between the resonators, otherwise it is reflected backwards. The magnitude of the standing waves established in a particular resonator is a function of, among other variables, the distance between the particular resonator and the preceding resonator. Consequently, the width of the passband of the filter 100 as a whole is a function of the ability of each resonator 102, 104, 106 to impart energy to a successive resonator 102, 104, 106.

FIGS. 2A and 2B depict a scheme by which filters such as the filter 100 depicted in FIG. 1 are tuned. FIG. 2A depicts two simplified resonators 200 and 202 disposed atop a substrate 204. The substrate 204 may have a ground plane disposed on the surface opposite the surface upon which the resonators 200 and 202 are disposed. The substrate is dielectric, and may be made of alumina, Duroid® microwave laminate, magnesium oxide, sapphire, or lanthanum aluminate, or other suitable material. The resonators and propagation paths are conductive and may be made of copper or gold, or superconductive materials, such as niobium or niobium-tin, and oxide supereonductors such as YBCO. A conductive cover 206 encloses the substrate 204 and resonators 200 and 202 thereby containing the electromagnetic fields. Exemplary electric field lines are depicted in FIG. 2A. The electric field between each resonator 200 and 202 and the surrounding environment takes on a particular form when the resonator 200 and 202 carries an electromagnetic wave with a frequency at the resonators" 200 and 202 resonant frequency. If the electric field is disturbed, the resonant frequency of each resonator 200 and 202 (and therefore the center frequency of the passband of the filter as a whole) is altered.

FIG. 2B depicts the impact of the introduction of tuning tips 208 and 210 through the metallic cover 206 into the interior of the filter holder. The substrate is illustrated by the designation 204. The tuning tips 208 and 210 may take on the form of treaded cylinders, which maybe brought into greater or lesser proximity of the resonators 200 and 202 by rotation thereof. The tuning tips 208 and 210 can be dielectric materials that have a permittivity that is greater than the permittivity of the air, or vacuum within the conductive cover 206. Consequently, the electric flux density throughout the tuning tips 208 and 210 is greater than that of the air or vacuum, surrounding it. The tuning tips 208 and 210 disturb the field, by drawing more of the field towards themselves. By bringing a tuning tip 208 or 210 into greater proximity of a resonator 200 or 202, a greater portion of the field surrounding the resonator is disturbed. As the field is disturbed, the resonant frequency of the resonator is disturbed as well. Thus, the filter as a whole may be tuned by bringing the tuning tips 208 and 210 into greater or lesser proximity of the resonators 200 and 202.

One particular drawback of such a scheme is that as the tuning tips 208 and 210 are adjusted for the sake of tuning the center frequency of the filter, the bandwidth of the filter changes as well. This occurs because as the tuning tips 208 and 210 are brought into greater proximity to the resonators 200 and 202, they draw a greater portion of the field through themselves, meaning that a lesser portion of the field is available for facilitating resonator-to-resonator interaction (this is true for the case where the tuning tips are made of dielectric material, and the resonator structure is such that inter-resonator coupling is achieved via electric fields, rather than magnetic fields). Since, as stated above, bandwidth of the filter is a function of the ability of each resonator to impart energy to a successive resonator, the bandwidth of the filter drops as the tuning tips are brought into proximity of the resonators. Of course, the tuning tips (or entire rod) may be made of a conductor or superconductor, and the structure of the resonators themselves may be such that inter-resonator coupling occurs via electric fields, magnetic fields, or a combination of the two. Thus, bringing a tuning tip into closer proximity to a resonator may cause the bandwidth to either increase or decrease, depending upon the design of the filter. In the specific instances shown herein, bandwidth is decreased when the tuning tip is brought into greater proximity to the resonators.

The aforementioned scheme exhibits another drawback. Various communication schemes demand various bandwidths. For example, some PCS schemes demand a bandwidth of 5 MHz, while others demand a bandwidth of 15 or 20 MHz. FIG. 3A depicts a first exemplary filter that has a bandwidth of 5 MHz, while FIGS. 3B and 3C depict exemplary filters having 15 and 20 MHz bandwidths, respectively. As follows from the foregoing discussion, and as is depicted in FIGS. 3A, 3B, and 3C, greater bandwidth is achieved by locating the resonators in closer proximity to one another. Unfortunately, because the tuning tips are to be located over the resonators, varying inter-resonator spacing means that a different conductive cover must be fabricated for each communication scheme. This is due to the tuning tips penetrating the conductive covers. In this physical arrangement, since the tuning tips must be located over the resonators, and if the resonators are located in different positions for different communication schemes, then the holes in the conductive cover—through which the tuning tips must pass—must be located in different physical areas of the conductive cover for varying schemes. It will be appreciated, however, that it is generally undesirable to require different conductive covers for each communication scheme (e.g., because the numbers of parts are proliferated and costs are raised).

As is evident from the foregoing, there exists a need for a scheme by which a substantially planar stripline, or microstrip, type filter may be tuned while minimizing impact on filter bandwidth. There also exists a need for a stripline type filter scheme that can exhibit varying bandwidths without altering the physical position of the resonators making up the filter.

SUMMARY OF THE INVENTION

A preferred embodiment of an apparatus constructed according to the principles of the present invention includes an inter-resonator coupling scheme for a filter. The filter preferably includes at least two resonators. An inter-resonator coupling member is located between successive resonators in the filter. Preferably, the coupling member is located adjacent an edge portion of the resonator which is distal from that portion of the resonator over which a tuning tip is located. By then adjusting the length and/or the proximity of the inter-resonator coupling member relative to the adjacent resonators, the ratio of energy transferred from resonator to resonator (via the inter-resonator coupling member) may be increased and/or decreased. By increasing the ratio of energy transferred from resonator to resonator, the bandwidth of the filter is increased and is made relatively insensitive to tuning which may occur via manipulation of field disturbances introduced by tuning tips.

Therefore, according to one aspect of the present invention, there is provided a stripline filter, comprising: a first resonator, the first resonator having a first edge, a first end and a second end, wherein the first edge extends generally from the first end to the second end of the first resonator; a second resonator, the second resonator having a second edge, a first end and a second end, wherein the second edge extends generally from the first end to the second end of the second resonator, wherein the first and second resonator are physically located opposing one another with the first edge generally parallel to the second edge; and a coupling member physically located between the first and second resonators, wherein the coupling member includes a first section that extends along the first edge, a third section that extends along the second edge, and a second section that extends between and connects the first and third sections, wherein the coupling member is arranged and configured to transfer energy between the first and second resonator and minimize the sensitivity to tuning of the filter.

According to another aspect of the invention, there is provided a stripline filter comprising: a first resonator having a first edge opposite a second resonator, which has a second edge opposite the first resonator; a source of field disturbance located proximate the first resonator, wherein the source of field disturbance is used for tuning the filter; and a coupling member interposed between the first and second resonators, wherein the coupling member has a first section that extends parallel to the first edge of the first resonator, and wherein the first section extends along a portion of the first edge that is distal from the source of field disturbance, but does not extend along a portion of the edge that is proximal the source of field disturbance.

According to yet another aspect of the present invention, there is provided a method of stabilizing bandwidth during tuning of a filter comprising at least first and second resonators, wherein the energy is transferred from the first resonator to the second resonator when a signal is introduced to the first resonator, and wherein the filter is tuned by introducing a field disturbance proximate at least the first resonator, the method comprising: providing a coupling member interposed between the first and second resonators, wherein the coupling member transfers a greater quantity of energy from the first resonator to the second resonator than is transferred via a propagation path passing proximate the field disturbance.

While the invention will be described with respect to preferred embodiment configurations and with respect to particular devices used therein, it will be understood that the invention is not to be construed as limited in any manner by either such configuration or components described herein. Also, while the particular types of resonators and filters are described herein, it will be understood that such resonators and filters are not to be construed in a limiting manner. Instead, the principles of this invention extend to tuning any filter in which adjacent resonators are employed. These and other variations of the invention will become apparent to those skilled in the art upon a more detailed description of the invention.

The advantages and features which characterize the invention are pointed out with particularity in the claims annexed hereto and forming a part hereof. For a better understanding of the invention, however, reference should be had to the drawings which form a part hereof and to the accompanying descriptive matter, in which there is illustrated and described a preferred embodiment of the invention.

BRIEF DESCRIPTION OF THE DRAWINGS

Referring to the drawings, wherein like numerals represent like parts throughout the several views.

DETAILED DESCRIPTION OF THE INVENTION

The principles of the present invention apply particularly well to its application in a filter application for electromagnetic waves. Such filters generally include a plurality of resonators. One environment in which such filters are commonly employed is in cellular telephone communication systems. However, such environment is illustrative and should not be viewed in a limiting manner.

Figure 1:
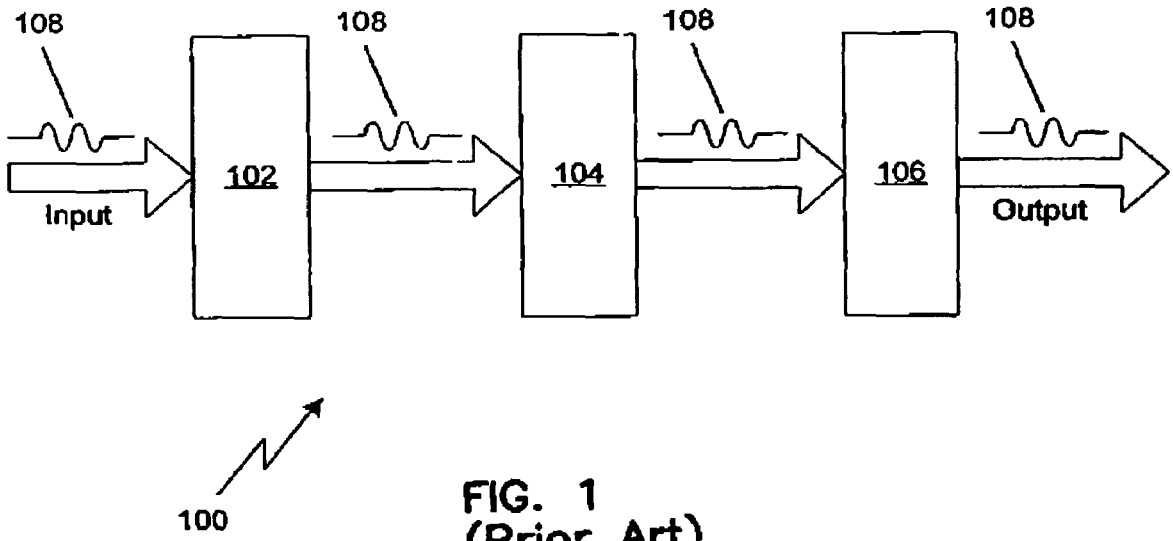
FIG. 1 (Prior Art)
FIG. 1 depicts a filter scheme known in the prior art.
Figure 2A:
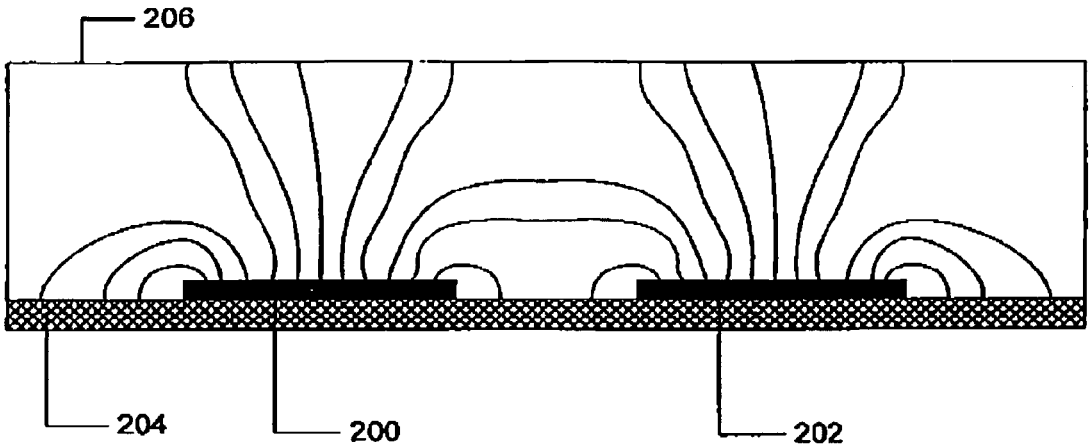
FIG. 2A (Prior Art)
FIGS. 2A and 2B depict a scheme for altering the resonant frequency of a pair of resonators, and therefore the center frequency of the filter in which the resonators are employed, using tuning tips located atop the resonators.
Figure 2B:
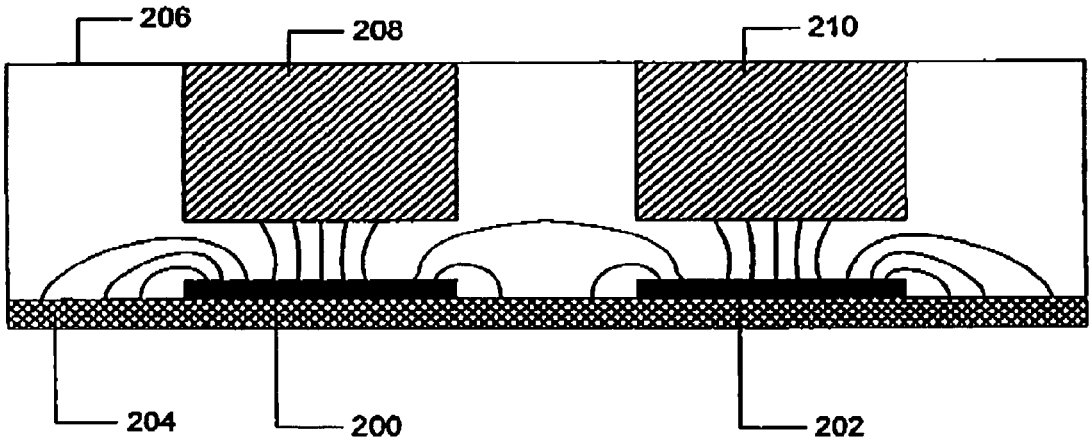
FIG. 2B (Prior Art)
Figure 3A:
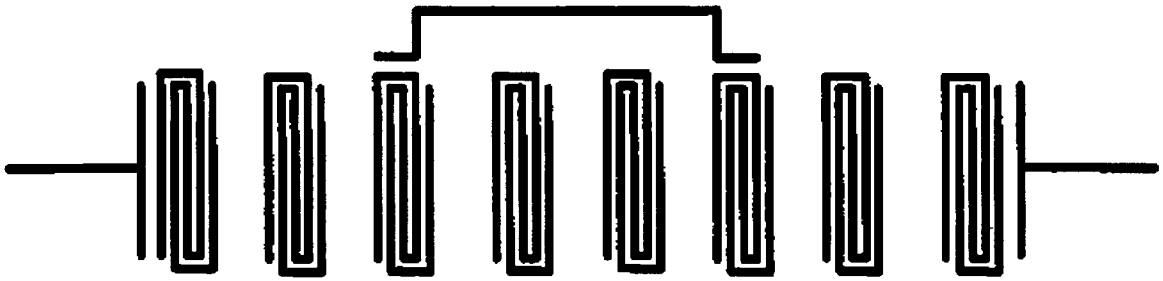
FIG. 3A (Prior Art)
FIGS. 3A, 3B, and 3C depict exemplary filter schemes known in the prior art for filters having bandwidths of 5, 15, and 20 MHz, respectively.
Figure 3B:
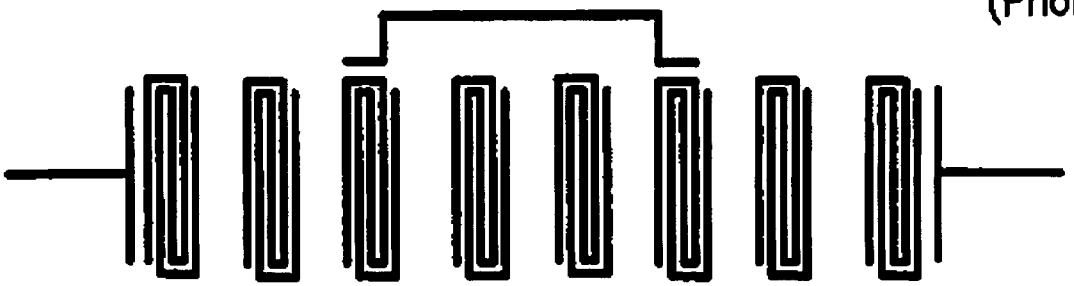
FIG. 3B (Prior Art)
Figure 3C:
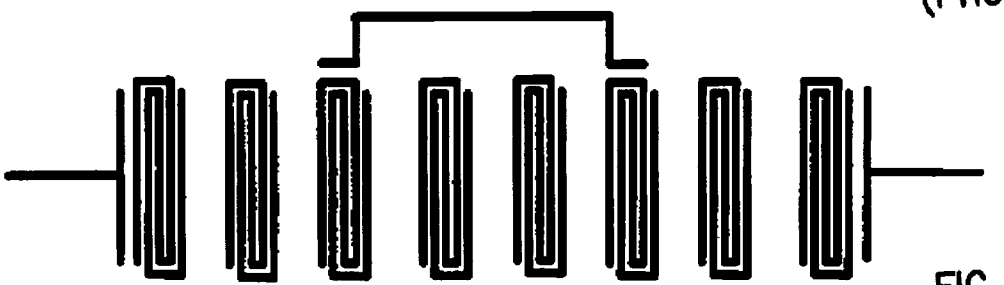
FIG. 3C (Prior Art)
Figure 4A:
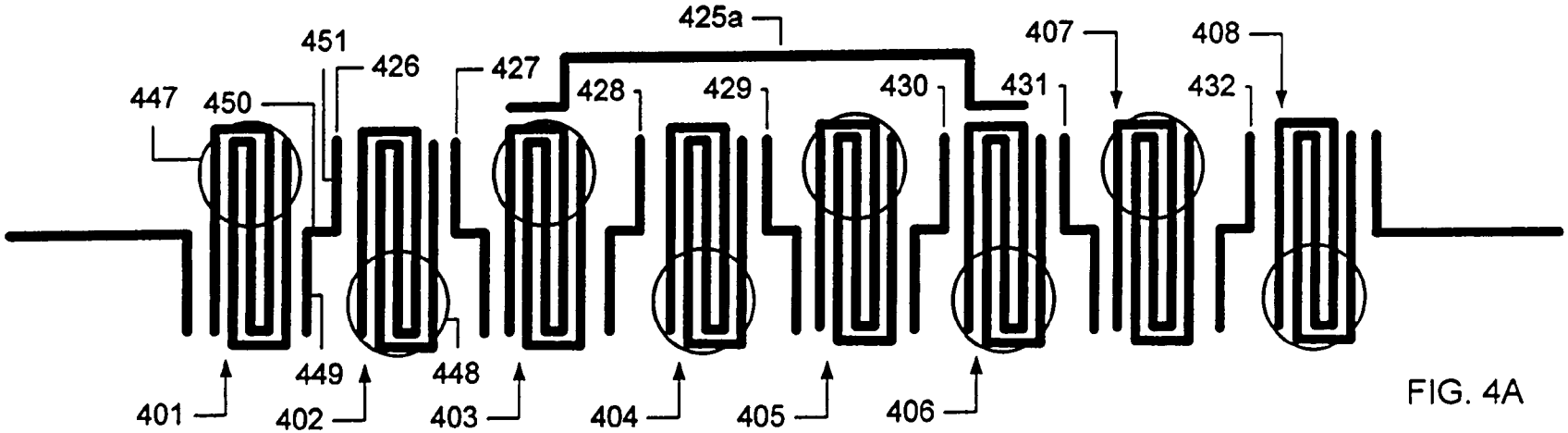
FIGS. 4A, 4B, and 4C depict an embodiment of a filter scheme according to one embodiment of the present invention.
Figure 4B:
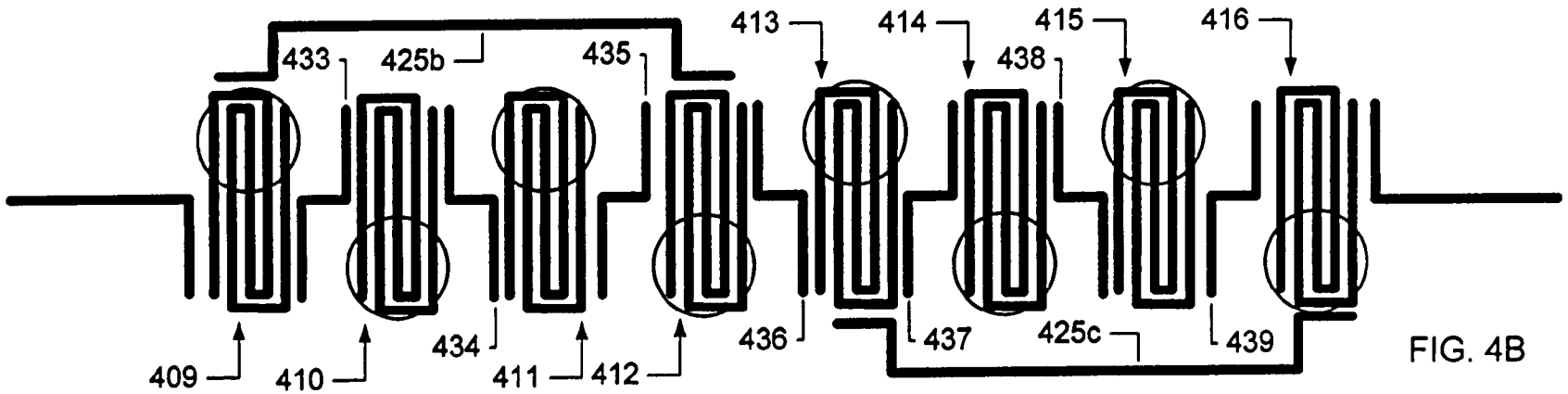
Figure 4C:
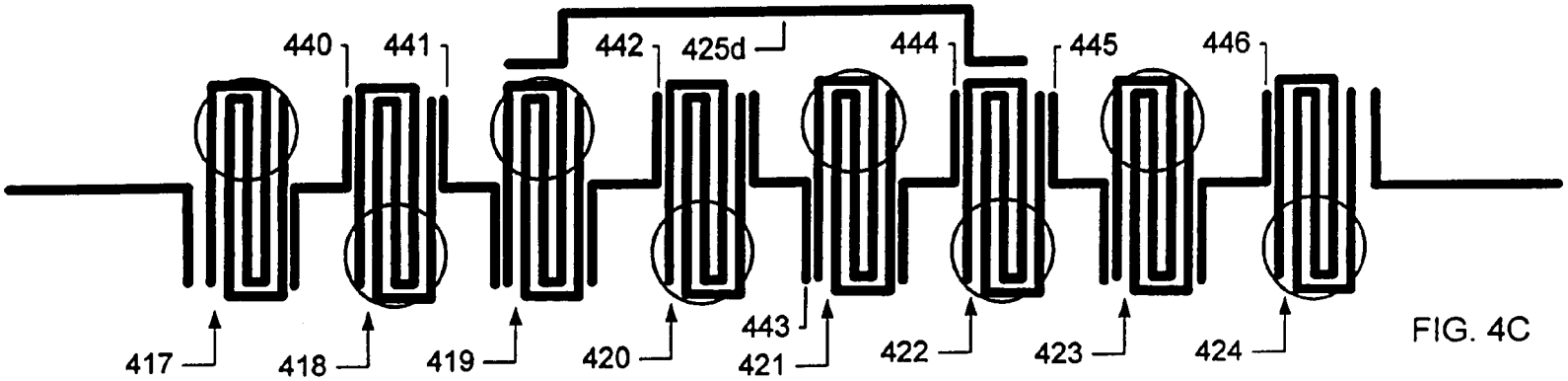

Turning now to FIGS. 4A, 4B, and 4C, such Figures depict a filtering scheme, constructed in accordance with the principles of the present invention, that addresses the drawbacks of the prior art. The filters depicted in FIGS. 4A, 4B, and 4C may operate in an environment similar to the one discussed above with reference to FIGS. 2A and 2B (i.e., the resonators may be made of similar materials, may reside atop a substrate made of similar material, and may be housed in a metallic cavity, etc.). FIG. 4A depicts a filter scheme that has a bandwidth of 5 MHz. FIGS. 4B and 4C depict filter schemes that have bandwidths of 15 and 20 MHz, respectively. As can be seen, the inter-resonator spacing is constant from filter to filter, meaning that a single metallic lid having holes through which tuning tips may pass can be used for all of the filters described in FIGS. 4A, 4B, and 4C. Rather than altering filter bandwidth by altering the spacing between resonators, bandwidth is altered by placing an inter-resonator coupling member(s) either closer to or farther from adjacent resonators. By orienting the inter-resonator coupling member closer to the adjacent resonators, bandwidth is increased. On the other hand, by orienting the inter-resonator coupling member further from the adjacent resonators, bandwidth is decreased.

More specifically, the filters depicted in FIGS. 4A, 4B and 4C each contain eight resonators 401, 402, 403, 404, 405, 406, 407 and 408 (FIG. 4A); 409, 410, 411, 412, 413, 414, 415 AND 416 (FIG. 4B); and 417, 418, 419, 420, 421, 422, 423 and 424 (FIG. 4C), respectively. A filter contains as many poles as it has resonators. Since the number of poles in a filter is a matter of design choice, so too is the number of resonators 401-424. Thus, although each filter is depicted as containing eight resonators 401-424, each filter could contain any number of resonators 401-424, in principle. Further, each filter is depicted as containing one or more cross-coupling members 425*a* (FIG. 4A); 425*b*, 425*c*, (FIG. 4B); and 425*d* (FIG. 4C). A filter contains either one or two zeros for each cross-coupling member 425*a* (FIG. 4A); 425*b*, 425*c*, (FIG. 4B); and 425*d* (FIG. 4C) in the filter. Since the number of zeros in a filter is a matter of design choice, so too is the number of cross-coupling members 425*a* (FIG. 4A); 425*b*, 425*c*, (FIG. 4B); and 425*d* (FIG. 4C). Thus, each filter may include a variety of cross-coupling schemes 425*a* (FIG. 4A); 425*b*, 425*c*, (FIG. 4B); and 425*d* (FIG. 4C), depending upon design considerations.

The physical location of the tuning tips over the resonators 401-424 are represented by circles in FIGS. 4A, 4B, and 4C. Representative tuning tips are designated as 447 and 448 in FIG. 4A. The tuning tips 447, 448 may be made of a dielectric material, such as sapphire or LaO, or may be made of conductive materials such as HTS materials. Should conductive or superconductive tuning tips/rods be used, then similar properties described herein from the use of dielectric tuning tips would result, if an appropriate change in resonator and coupling design were made. Such a change to conductive tuners would then affect the magnetic and electric fields of the resonators.

Between each of the adjacent resonators 401-424 in FIGS. 4A, 4B, and 4C is an inter-resonator coupling member 426, 427, 428, 429, 430, 431 and 432 (FIG. 4A); 433, 434, 435, 436, 437, 438 and 439 (FIG. 4B); and 440, 441, 442, 443, 444, 445 and 446 (FIG. 4C). The inter-resonator coupling members 426-446 provide a propagation path between successive, adjacent resonators 401-424, so that the field disturbances caused byte various tuning tips affect only slightly the field interaction between adjacent resonators 401-424.

By way of example, attention is directed to inter-resonator coupling member 426. This inter-resonator coupling member 426 is located between resonators 401 and 402, and provides a propagation path by which an electromagnetic field resonating in resonator 401 may propagate to resonator 402. By virtue of the shape and orientation of the inter-resonator coupling member 426, and the positioning of the tuning tips 447 and 448, the inter-resonator coupling member's 426 ability to transfer an electric field from resonator 401 to resonator 402 is substantially unaffected by the selected proximity of tuning tip 447 or 448 to their respective resonators 401 and 402.

Still referring to FIG. 4A, it can be seen that the inter-resonator coupling member 426 contains a first section 449 that runs in close proximity and substantially parallel to the adjacent side of resonator 401. This section 449 extends along a portion of the resonator 401 that is not directly adjacent the tuning tip 447, so as to minimize the effect of tuning tip 447 on the inter-resonator coupling member 426. Inter-resonator coupling member 426 also contains a second section 450 that extends toward adjacent resonator 402, running substantially perpendicular to the sides of either resonator 401 and 402. Finally, inter-resonator coupling member 426 contains a third section 451 that runs in close proximity and substantially parallel to the adjacent side of resonator 402. The third section 451 extends along a portion of resonator 402 that is not directly adjacent the tuning tip 448, so as to minimize the effect of tuning tip 448 on the inter-resonator coupling member 426. The choice of lengths, widths and gaps of these coupling members are made such that the resulting aggregate resonator-to-resonator coupling is appropriate to substantially preserve the absolute bandwidth with a change in center frequency of the resonators.

When an electromagnetic field resonates in resonator 401, it has two paths of propagation toward adjacent resonator 402. First, the field may propagate directly through space towards resonator 402. Second, the field may propagate through inter-resonator coupling member 426 towards resonator 402. By virtue of the disturbance caused by tuning tip 447, a relatively small amount of the field energy is transferred from resonator 401 to resonator 402 through space. However, because the inter-resonator coupling member 426 runs along a side of the resonator 401 that is distal from the tuning tip 447, a relatively large amount of the field energy is transferred from resonator 401 to resonator 402 through the inter-resonator coupling member 426. In particular, first section 449 runs along a side of resonator 401.

The ratio of energy transferred via space versus that transferred via the inter-resonator coupling member is a function of the following two variables (amongst other variables): (1) the distance between the inter-resonator coupling member and the adjacent resonators; and (2) the length of the first and third members of the inter-resonator coupling members. By reducing the gap between the inter-resonator coupling member and the adjacent resonators, a greater ratio of energy is transferred via the inter-resonator coupling member, and the bandwidth of the filter is generally is increased. By lengthening the first or third members of the inter-resonator coupling member, a greater ratio of energy is transferred via the inter-resonator coupling member, and the bandwidth of the filter is generally is increased. The ratio of energy transferred via the air versus that transferred via the inter-resonator coupling member is a matter of design choice and can vary from application to application. Coupling requirements vary throughout the filter and for filters with different performance requirements and bandwidths, as known by those of skill in the art. Examples of three different bandwidth filters are given in FIGS. 4A, 4B, and 4C where differences exist between the coupling gaps, between the coupling members, and between the adjacent resonators.

It is important that the coupling obtained via the path through space/air is more sensitive to tuning than is the coupling obtained via the inter-resonator coupling members. Consider the total coupling bandwidth ($B_t$(f)) between resonators 1 and 2 is a function of frequency:

$$B_t(f)=B_1(f)+B_2(f),$$

where $B_1$(f) represents coupling bandwidth obtained via space/air, and $B_2$(f) represents coupling bandwidth obtained via an inter-resonator coupling member.

When the resonators are tuned to f+df, $$B_t(f+df)=B_1(f+df)+B_2(f+df)\approx B_1(f+df)+B_2(f),$$

because $B_2$(f) is insensitive to frequency change.

Therefore, the total relative coupling change is:

$$[B_t(f+df)-B_t(f)]/B_t(f)\approx[B_1(f+df)-B_1(f)]/[B_1(f)+B_2(f)].$$

Thus, if $B_2(f)>>B_1(f)$, the relative change may be extremely small.

Figure 5:
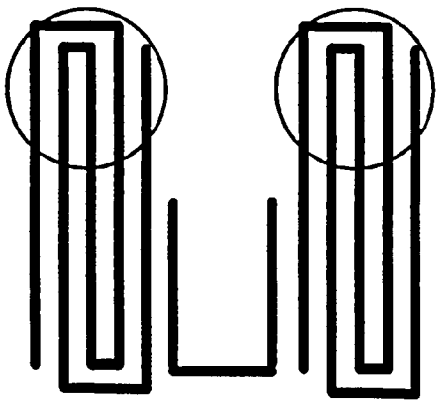
FIG. 5 depicts another embodiment of an inter-resonator coupling member according to one embodiment of the present invention.

Although the inter-resonator coupling members are presented as having a particular geometry, other geometries will readily present themselves to those of ordinary skill in the art and are within the scope of this disclosure. For example, the inter-resonator coupling members may be U-shaped, as shown in FIG. 5. Per such an embodiment, in order to avoid changes in coupling due to the position of the tuning tips, the tuning tips are preferably located along the same edge from resonator to resonator, rather than being staggered as shown in FIGS. 4A, 4B, and 4C.

Figure 6:
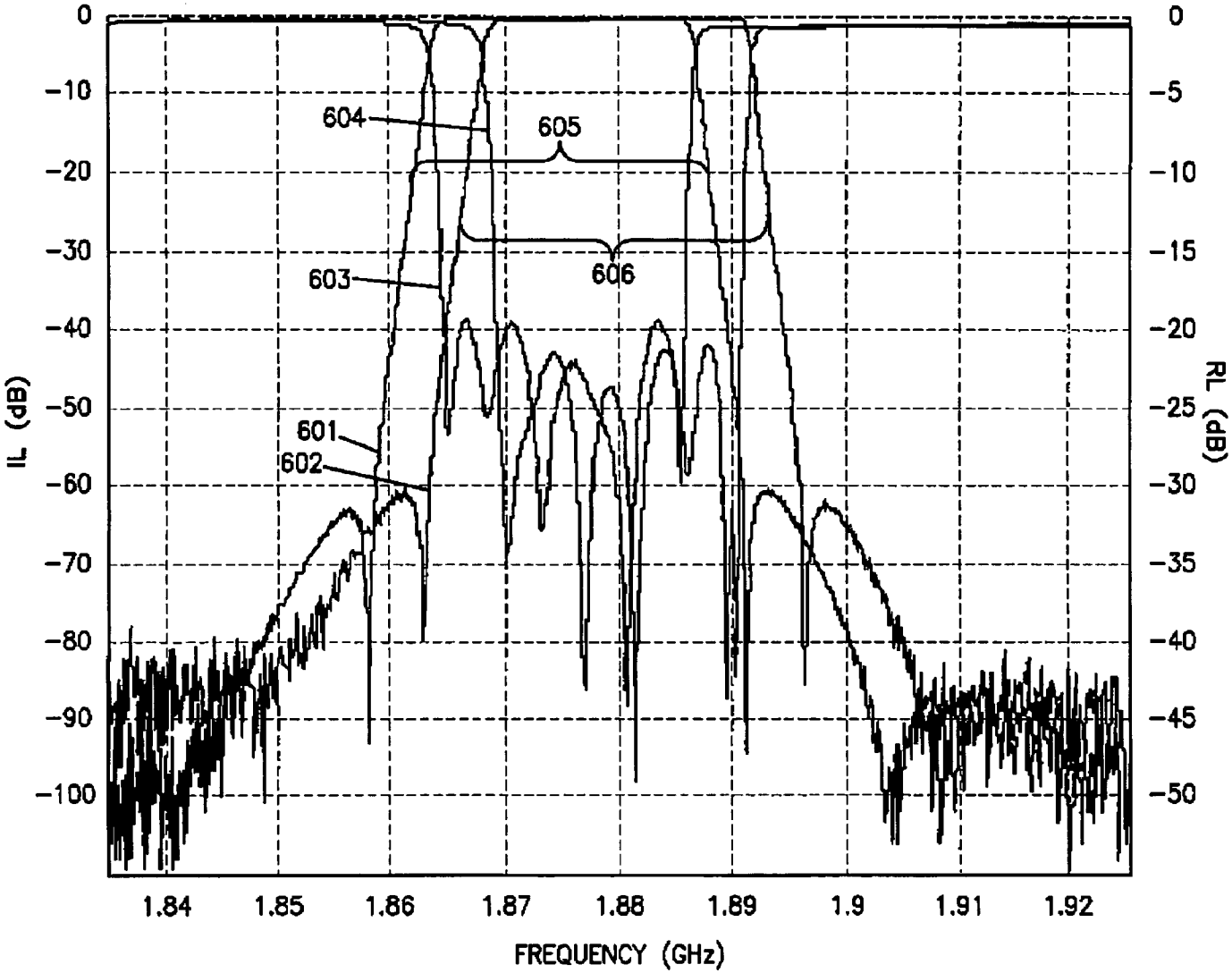
FIG. 6 depicts a graph of the response of an exemplary 20 MHz bandwidth filter, according to one embodiment of the present invention.

FIG. 6 demonstrates that the inter-resonator coupling structures provide the desired advantage of minimizing alteration of bandwidth when the filter is tuned. FIG. 6 relates to the filter depicted in FIG. 4C and depicts a graph having plotted thereon four curves 601-604. The vertical axes of the graph are IL (db) and RL (db), while the horizontal axis is Frequency (GHZ). Curve 601 depicts the attenuation level of the filter depicted in FIG. 4C (i.e., the 20 MHz bandwidth filter) when it is tuned to have a center frequency of 1.876 GHz. Curve 602 depicts the attenuation level of the filter depicted in FIG. 4C when it is tuned to have a center frequency of 1.880 GHz. Curves 603 and 604 depict the reflection levels of the filter when it is tuned to 1.876 and 1.880GHz, respectively. Bracket 605 depicts the bandwidth of the filter when it is tuned to 1.876 GHz. Bracket 606 depicts the bandwidth of the filter when it is tuned to 1.880 GHz. As can be seen, the bandwidth of the filter remains nearly constant, even though the center frequency has been shifted by approximately 4 MHz. Similar results are obtained for each of the exemplary circuits depicted in FIGS. 4A and 4B.

Figure 7:
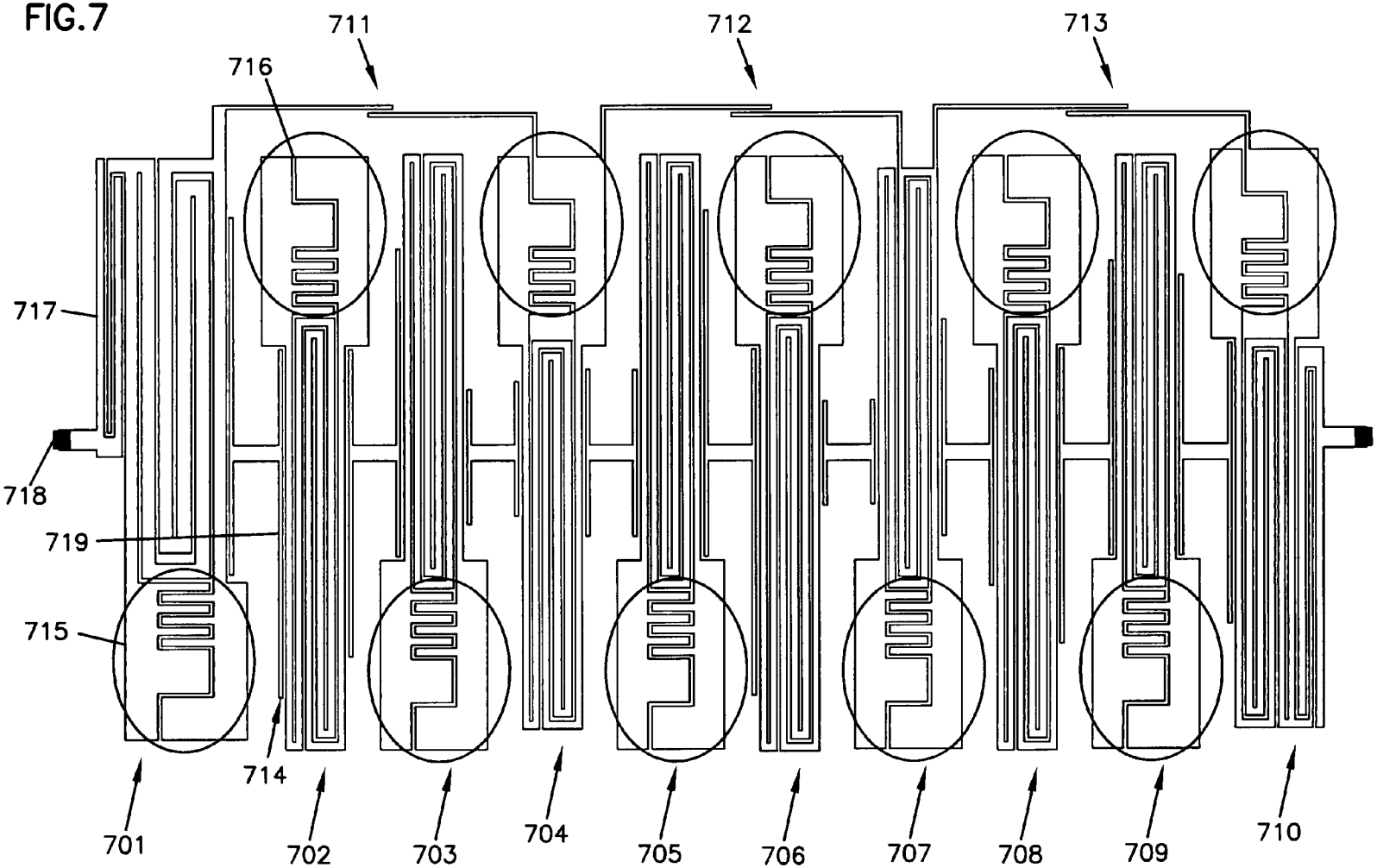
FIG. 7 depicts an embodiment of another filter scheme according to one embodiment of the present invention.

FIG. 7 depicts a filter having ten resonators 701, 702, 703, 704, 705, 706, 707, 708, 709 and 710. The filter depicted in FIG. 7 may operate in an environment similar to the one discussed with reference to FIGS. 2A and 2B (i.e., the resonators may be made of similar materials, may reside atop a substrate made of similar material, and may be housed in a metallic cavity, etc.). As stated above, a filter contains as many poles as it has resonators. Since the number of poles in a filter is a matter of design choice, so too is the number of resonators 701-710. Thus, although the filter in FIG. 7 is deplicted as containing ten resonaters 701-710, each filter could contain any number of resonators 701-710, in principal. Further, the filter of FIG. 7 is deplicted as containing three cross-coupling members 711, 712, and 713. As stated above, a filter contains either one or two zeros for each cross-coupling member 711, 712, and 713 in the filter. Since the number of zeros in a filter is a matter of design choice, so too is the number of cross-coupling members 711, 712, and 713. Thus each filter may include a variety of cross-coupling schemes 711, 712, and 713, depending upon design considerations. The bandwidth of the filter of FIG. 7 may be selected by selecting the length and proximity of the substantially parallel sections of the various inter-resonator coupling members to their respective adjacent resonators.

Between each of the resonators 701-710 in FIG. 7 is an inter-resonator coupling member, one of which is identified with reference numeral 714. The inter-resonator coupling members 714 provide a propagation path between successive resonators 701-710, so that the field disturbances caused by the various tuning tips (represented by circles in FIG. 7) affect only slightly the field interaction between adjacent resonators 701-710.

Using inter-resonator coupling member 714 by way of example, this inter-resonator coupling member 714 is located between resonators 701 and 702. Inter-resonator coupling member 714 provides a propagation path by which an electromagnetic field resonating in resonator 701 may propagate to resonator 702. By virtue of the shape and orientation of the inter-resonator coupling member 714, and the positioning of the tuning tips (represented in FIG. 7 by circles, and exemplary tuning tips designated at 715 and 716), the inter-resonator coupling member's ability to transfer energy resonator 701 to resonator 702 is substantially unaffected by the selected proximity of tuning tip 715 or 716 to their respective resonators 701 and 702. As can be seen from FIG. 7, the inter-resonator coupling member 714 contains a first section 717 that runs in close proximity and substantially parallel to the adjacent side of resonator 701. This section 717 extends along a portion of resonator 701 that is not directly adjacent the tuning tip 715, so as to minimize the effect of tuning tip 715 on the inter-resonator coupling member 714. Inter-resonator coupling member 714 also contains a second section 718 that joins the first member at a point intermediate the ends of the first section 718, and extends toward adjacent resonator 702, running substantially perpendicular to the sides of either resonator 701 and 702. Finally, inter-resonator coupling member 714 contains a third section 719 that runs in close proximity and substantially parallel to the adjacent side of resonator 702. The third section 719 extends along a portion of resonator 702 that is not directly adjacent the tuning tip 716, so as to minimize the affect of tuning tip 716 on the inter-resonator coupling member 714. As can be seen from FIG. 7, the second section 718 of the inter-resonator coupling member joins the third section 719 at a point that is intermediate the ends of the third section 719.

As was the case with the filters depicted in FIGS. 4A-4C, when an electromagnetic field resonates in resonator 701, it has two paths of propagation toward adjacent resonator 702. First, the field may propagate through the air towards resonator 702. Second, the field may propagate through inter-resonator coupling member 714 towards resonator 702. A relatively small amount of the field energy is transferred from resonator 701 to resonator 702 through the air. However, because the inter-resonator coupling member 714 runs along a side of the resonator 701 that is distal from the tuning tip 714, a relatively large amount of the field energy is transferred from resonator 701 to resonator 702 through the inter-resonator coupling member 714. The ratio of energy transferred via the air versus that transferred via the inter-resonator coupling member is a matter of design choice and can vary from application to application.

One of the differences between the inter-resonator coupling members depicted in FIG. 7 and those shown in FIGS. 4A-4C is that the first and third members 717 and 719 of the coupling members of FIG. 7 are elongated when compared to those of FIG. 4. The filter of FIG. 7 is designed to have a center frequency in the range of 842 MHz, as opposed to the filters depicted in FIG. 4, which have a center frequency that is approximately 1 GHz higher. Due to the comparatively low center frequency of the filter depicted in FIG. 7, the first and third sections 717 and 719 of the coupling members 714 are elongated to provide sufficient coupling. As an alternative to elongation of the first and third members 717 and 719, the first and third sections may be placed in greater proximity to the sides of the adjacent resonators 701 and 702. However, such an approach may prove to be particularly sensitive to geometric tolerances that may be incurred during fabrication.

Figure 8:
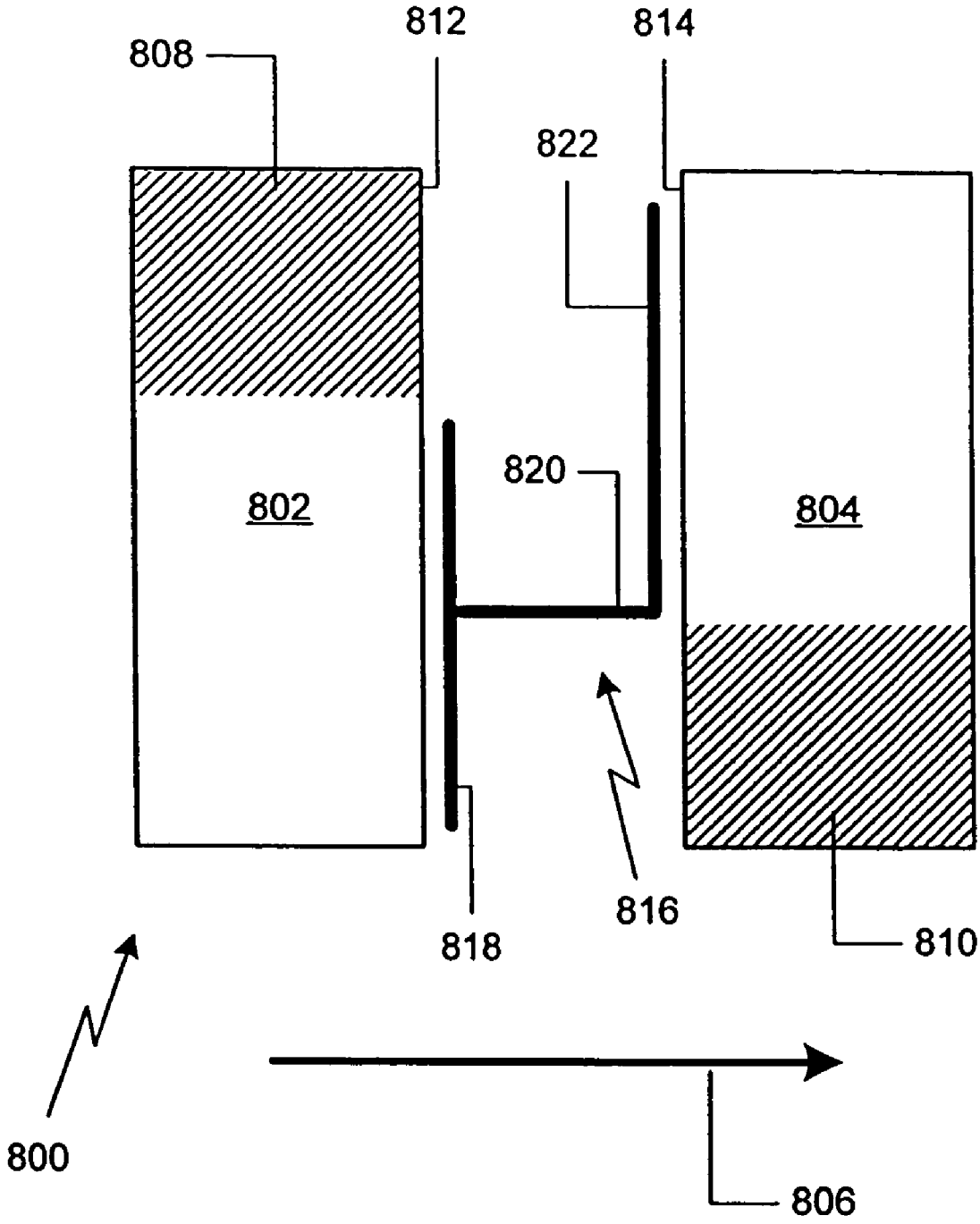
FIG. 8 depicts the inter-resonator coupling scheme generally.

FIG. 8 depicts the inter-resonator coupling scheme generally. As can be seen from FIG. 8, a filter 800 includes at least two resonators 802 and 804. An electromagnetic wave propagates through the filter 800, from resonator 802 to resonator 804, generally along a propagation direction indicated by the arrow 806.

A source of field disturbance is introduced to one or both of the resonators 802 and 804. The source of field disturbance may be a tuning tip that is introduced to a region proximate a resonator 802 or 804 (e.g., oriented above the resonator in the z-direction, where the z-direction is defined by a vector running perpendicular to the surface of the resonator), but may take on other forms, as well. The physical principle by which the field disturbance operates may be the introduction of a material having a permittivity different from that of the surrounding environment, or may be due to another physical principle as well. The field disturbance is most strongly experienced in the shaded regions 808 and 810. While the source of the field disturbance may actually influence the electromagnetic fields throughout the entire filter (at least to some degree), the disturbance is most profound in the shaded regions.

An inter-resonator coupling member 816 is interposed between the first and second resonators 802 and 804. The first resonator 802 has an edge 812 that is opposite the second resonator 804 and is substantially perpendicular to the propagation direction 806 of the electromagnetic wave. Similarly, the second resonator 804 has an edge 814 that is opposite the first resonator 802 and is substantially perpendicular to the propagation direction 806 of the electromagnetic wave.

The inter-resonator coupling member 816 is made of a conductive or superconductive material (such as those described above) and contains at least three sections. The first section 818 runs substantially parallel to edge 812 (i.e., runs along the edge of the first resonator 802 that is opposite the second resonator 804 and is substantially perpendicular to the propagation direction). The first section 818 preferably extends along a portion of edge 812 that is not profoundly influenced by the source of field disturbance (e.g., is distal from the region profoundly affected by the source of field disturbance), and preferably does not extend along the portion of edge 812 that is most profoundly influenced by the source of field disturbance. Similarly, the third section 822 runs substantially parallel to edge 814 (i.e., runs along the edge of the second resonator 804 that is opposite the first resonator 802 and is substantially perpendicular to the propagation direction). The third section 822 preferably extends along a portion of edge 814 that is not profoundly influenced by the source of field disturbance (e.g., is distal from the region profoundly affected by the source of field disturbance), and preferably does not extend along the portion of edge 814 that is most profoundly influenced by the source of field disturbance.

A second section 820 connects the first and third sections 818 and 822. The second section 820 may extend substantially parallel to the propagation direction. Alternatively, the second section 820 may be zig-zagged, at an angle to either the first or third section 818 or 822, or may extend in a curvilinear shape between the first and third sections 818 and 822. The second section 820 may join the first or third sections 818 or 822 at the edge of either section or at an intermediate point.

The ratio of energy transferred from resonator 802 to 804 via the inter-resonator coupling member may be increased by either extending section 818 or 822, or by bringing section 818 or 822 closer to their respective adjacent resonator edges 812 and 814. By increasing the ratio of energy transferred from resonator 802 to 804 via the inter-resonator coupling member, the bandwidth of the filter 800 is increased and is made relatively insensitive to tuning which may occur via manipulation of the field disturbances.

It will be appreciated that the principles of this invention apply not only to the physical apparatus of an inter-resonator coupling member, but also to the method of connecting adjacent, successive resonators. While particular embodiments of the invention have been described with respect to its application, it will be understood by those skilled in the art that the invention is not limited by such application or embodiment or the particular components disclosed and described herein. It will be appreciated by those skilled in the art that other components that embody the principles of this invention and other applications therefor other than as described herein can be configured within the spirit and intent of this invention. The arrangements described herein are provided as examples of embodiments that incorporate and practice the principles of this invention. Other modifications and alterations are well within the knowledge of those skilled in the art and are to be included within the broad scope of the appended claims.

What is claimed is:

1. A stripline filter, comprising:

a) a first resonator, the first resonator having a first edge, a first end and a second end, wherein the first edge extends generally from the first end to the second end of the first resonator;

b) a second resonator, the second resonator having a second edge, a first end and a second end, wherein the second edge extends generally from the first end to the second end of the second resonator, wherein the first and second resonator are physically located opposing one another with the first edge generally parallel to the second edge; and c) a coupling member physically located between the first and second resonators, wherein the coupling member includes a first section that physically extends only along a portion of the first edge at the second end, a third section that physically extends only along a portion of the second edge at the first end, and a second section that extends between and connects the first and third sections, wherein the coupling member is non-resonant in a passband of the stripline filter and is arranged and configured to transfer energy between the first and second resonator and minimize the sensitivity to tuning of the filter.

2. The stripline filter of claim 1, wherein a first source of field disturbance is introduced above the first end of the first resonator.

3. The stripline filter of claim 2, wherein the first source of field disturbance is a tuning tip.

4. The stripline filter of claim 2, wherein a second source of field disturbance is introduced above the second end of the second resonator.

5. The stripline filter of claim 4, wherein the second source of field disturbance is a tuning tip.

6. The stripline filter of claim 4, wherein the first section does not extend along the first edge proximal the first source of field disturbance.

7. The stripline filter of claim 6, wherein the third section does not extend along the second edge proximal the second source of field disturbance.

8. The stripline filter of claim 1, wherein:

a) a first tuning tip is introduced above the first end of the first resonator, and the first section physically extends along the first edge at said second end;

b) a second tuning tip is introduced above the second end of the second resonator, and the third section physically extends along the second edge at the first end; and c) the first section does not extend along the first edge proximal the first tuning tip and the third section does not extend along the second edge proximal the second tuning tip.

9. The stripline filter of claim 8, further comprising a cover located over the first and second resonators, the cover having holes disposed therein through which the first and second tuning tips extend, wherein the coupling member is arranged and configured so that said cover is a commonly designed cover which may be employed for different filters.

10. A stripline filter comprising:

a first resonator having a first edge opposite a second resonator, which has a second edge opposite the first resonator;

a source of field disturbance located proximate the first resonator, wherein the source of field disturbance is used for tuning the filter; and a coupling member interposed between the first and second resonators, wherein the coupling member is non-resonant in a passband of the stripline filter and has a first section that extends parallel to the first edge of the first resonator, and wherein the first section extends along a portion of the first edge that is distal from the source of field disturbance, but does not extend along a portion of the first edge that is proximal the source of field disturbance.

11. The stripline filter of claim 10, wherein the source of field disturbance is a tuning tip.

12. The stripline filter of claim 11:

a) further comprising a second source of field disturbance located proximate the second resonator, the second source of field disturbance being used for tuning the filter; and b) wherein the coupling member further includes a second section and a third section, the third section extending generally parallel to the second edge of the second resonator and along a portion of the second edge that is distal from the second source of field disturbance, but does not extend along a portion of the second edge that is proximal the second source of field disturbance, and the second section cooperatively connecting the first and third sections.

13. The stripline filter of claim 12, wherein the second source of field disturbance is another tuning tip.

14. The stripline filter of claim 13, further comprising a cover located over the first and second resonators, the cover having holes disposed therein through which the tuning tips extend, wherein the coupling member is arranged and configured so that said cover is a commonly designed cover which may be employed for different filters.

15. The stripline filter of claim 14, wherein the second section is generally perpendicular to the first and second edges.

16. A method of stabilizing bandwidth during tuning of a filter comprising at least first and second resonators, wherein energy is transferred from the first resonator to the second resonator when a signal is introduced to the first resonator, and wherein the filter is tuned by introducing a field disturbance proximate at least the first resonator, the method comprising:

providing a coupling member interposed between the first and second resonators, wherein the coupling member transfers a greater quantity of the energy from the first resonator to the second resonator than is transferred via a propagation path passing proximate the field disturbance and wherein the coupling member is non-resonant in a passband of the filter.

* * * * *

UNITED STATES PATENT AND TRADEMARK OFFICE

CERTIFICATE OF CORRECTION

PATENT NO. : 7,610,072 B2
APPLICATION NO. : 10/944339
DATED : October 27, 2009
INVENTOR(S) : Ye It is certified that error appears in the above-identified patent and that said Letters Patent is hereby corrected as shown below:

Col. 2, line 10: "oxide supereonductors such as" should read --oxide superconductors such as--

Col. 2, line 25: "form of treaded cylinders," should read --form of threaded cylinders,--

Col. 6, line 13: "caused byte various" should read --caused by the various--

Col. 8, lines 11-13: "deplicted as containing ten resonaters 701-710, each filter could contain any number of resonators 701-710, in principal. Further, the filter of FIG. 7 is deplicted as containing" should read --depicted as containing ten resonators 701-710, each filter could contain any number of resonators 701-710, in principle. Further, the filter of FIG. 7 is depicted as containing--

Signed and Sealed this

Second Day of November, 2010

David J. Kappos

David J. Kappos
*Director of the United States Patent and Trademark Office*